US006035621A

United States Patent [19]

Scheerer et al.

[11] Patent Number: 6,035,621

[45] Date of Patent: Mar. 14, 2000

[54] SPINNING APPARATUS, METHOD OF PRODUCING YARNS, AND RESULTING YARNS

[75] Inventors: Todd Joseph Scheerer; Winston Patrick Moore; Jesse Robert Fletcher, all of Charlotte; Rudy Lee Crews, Gastonia, all of N.C.

[73] Assignee: Wellman, Inc., Shrewsbury, N.J.

[21] Appl. No.: 09/261,513

[22] Filed: Mar. 3, 1999

Related U.S. Application Data

[62] Division of application No. 08/844,463, Apr. 18, 1997, Pat. No. 5,950,413.

[51] Int. Cl.[7] ..... D02G 3/02

[52] U.S. Cl. ..... 57/224; 57/227

[58] Field of Search ..... 57/315, 328, 333, 57/210, 224, 227; 19/236, 256, 260, 261

[56] References Cited

U.S. PATENT DOCUMENTS

| | | | |
|---|---|---|---|
| 1,696,553 | 12/1928 | Owens . | |
| 3,079,746 | 3/1963 | Field . | |
| 3,105,998 | 10/1963 | Raboisson | 19/260 |
| 3,458,987 | 8/1969 | Ozawa et al. . | |
| 3,487,619 | 1/1970 | Field . | |
| 3,596,456 | 8/1971 | Hiroshi et al. | 57/315 |
| 3,646,745 | 3/1972 | Baldwin et al. . | |
| 3,978,648 | 9/1976 | Alker | 57/152 |
| 4,088,016 | 5/1978 | Watson et al. . | |
| 4,369,622 | 1/1983 | Teed et al. | 57/315 |
| 4,387,487 | 6/1983 | Nakahara et al. . | |
| 4,428,752 | 1/1984 | Goldenstein | 57/227 |
| 4,461,058 | 7/1984 | Gaudino . | |
| 4,512,061 | 4/1985 | Hartmannsgruber et al. . | |
| 4,644,609 | 2/1987 | Lattner . | |
| 4,667,463 | 5/1987 | Minotikawa et al. | 57/328 |
| 4,845,813 | 7/1989 | Salaun et al. . | |
| 5,038,553 | 8/1991 | Stadler . | |
| 5,400,476 | 3/1995 | White . | |
| 5,481,863 | 1/1996 | Ota . | |
| 5,497,608 | 3/1996 | Matsumoto et al. | 57/224 |
| 5,568,719 | 10/1996 | Proctor | 57/224 |
| 5,749,212 | 5/1998 | Rees et al. | 57/225 |

FOREIGN PATENT DOCUMENTS

| | | |
|---|---|---|
| 222981 | 5/1987 | European Pat. Off. . |
| 372255 | 6/1990 | European Pat. Off. . |
| 2268096 | 11/1975 | France . |
| 4225243 | 2/1993 | Germany . |
| 4308392 | 9/1993 | Germany . |
| 5106121 | 4/1993 | Japan . |

*Primary Examiner*—William Stryjewski
*Attorney, Agent, or Firm*—Philip Summa, Patent Attorney

[57] ABSTRACT

A spinning apparatus is disclosed according to the invention having a drafting zone comprising at least four roll pairs for drawing a sliver comprising one or more types of staple fibers. The rolls pairs include a back roll pair, intermediate roll pairs and a front roll pair and the distance between the nip of the back roll pair and the nip of the adjacent intermediate roll pair, and the distances between the nips of adjacent intermediate roll pairs is no more than the effective fiber length of the longest staple fiber type in the sliver. The drafted sliver may be spun into yarns at high speeds, such as the speeds used in air jet spinning apparatus to provide yarns having increased strength and reduced defects. The present invention also includes a method of forming high quality and high uniformity yarns by advancing a sliver through a drafting apparatus and thereafter spinning the sliver into yarn.

5 Claims, 3 Drawing Sheets

SPINNING APPARATUS, METHOD OF PRODUCING YARNS, AND RESULTING YARNS

This application is a division of Ser. No. 08/844,463 filed Apr. 18, 1997 now U.S. Pat. No. 5,950,413.

FIELD OF THE INVENTION

The present invention relates to yarn spinning and more particularly, relates to a novel method of drafting sliver in a spinning apparatus to form highly uniform yarns having good mechanical properties.

BACKGROUND OF THE INVENTION

One common method of forming single yarns has been the use of a spinning apparatus which drafts and twists prepared strands of fibers to form the desired yarn. One of the first yarn spinning apparatus was the mule spinning frame which was developed in 1782 and used for wool and cotton fibers. Many decades later, the ring spinning apparatus was developed to increase the spinning speed and quality of the spun yarn. Although good quality natural yarns may be produced by ring spinning, the rate of ring spinning remains relatively slow, e.g., less than about 15 meters/minute. In the last few decades, other various types of spinning apparatus which operate at higher speeds than ring spinning apparatus have been introduced. For example, rotor spinning, friction spinning and air-jet spinning methods are capable of spinning sliver into yarn at speeds greatly exceeding ring spinning speeds.

Prior to spinning sliver into yarn, the fibers are typically processed by carding and other various methods and then drawn to attenuate or increase she length per unit weight of the sliver. The sliver is generally drawn in a drafting zone comprising a series of drafting roll pairs with the speed of successive roll pairs increasing in the direction of sliver movement to draw the sliver down to the point where it approaches yarn width. Numerous parameters have traditionally been adjusted in the drafting zone to attempt to maximize the drafting and quality of the sliver including draft roll spacings, draft roll diameters, draft roll speeds (ratios), draft distribution, and fiber blending (e.g., drawframe and intimate blending).

One particular parameter, the draft roll spacing between adjacent roll pairs, is normally defined by the distance between the nip, i.e., the line or area of contact, between one pair of rolls and the nip of an adjacent pair of rolls. The conventional wisdom for draft roll spacings, especially for higher speed spinning processes such as air jet spinning, has been to set the distance between adjacent nips at greater than the fiber length of the staple fibers in the sliver. See, e.g., U.S. Pat. No. 4,088,016 to Watson et al. and U.S. Pat. No. 5,400,476 to White. This particular roll spacing has been widely accepted as the industry standard based on the rationale that smaller roll spacing results in increased breakage of fibers. Specifically, when the roll spacing is less than the fiber length, individual fibers may extend from one nip to an adjacent nip or bridge adjacent nips. Because adjacent pairs of rollers operate at different speeds, the bridged fibers may become pulled apart thus resulting in breakage of the fibers. This fiber breakage can result in low yarn quality and even yarn breakage in subsequent processing equipment such as spinning apparatus which may require the processing equipment to be shut down. Thus, draft roll spacings of greater than the fiber length have been the standard in the textile industry.

The standard draft roll spacings produce yarns having good uniformity and mechanical properties. Nevertheless, there is always a need In the art to improve the uniformity and the mechanical properties of the yarn. Several attempts have been made to the drafting and spinning process to improve certain aspects of the spun yarn. For example, U.S. Pat. No. 5,481,863 to Ota describes decreasing the distance between the nip of the front roll pair of drafting rolls and the nip of the delivery rolls (located after spinning) to less than the longest fiber length to reduce ballooning in the air nozzles of the spinning apparatus. Additionally, U.S. Pat. No. 3,646,745 to Baldwin describes decreasing the distances between the nips of the front pair and the adjacent intermediate pair of drafting rolls to less than the effective staple length of the fibers in ring spinning processes to reduce the formation of "crackers" caused by overlength staple fibers. Nevertheless, no drafting takes place between the narrowly spaced rolls described in these patents and thus the problem of fiber breakage is not a danger in decreasing the roll spacings in these patents.

Therefore, there is a need to provide a method which allows for the use of the highest possible speed equipment on staple and blended fibers while producing a high quality yarn with good mechanical properties.

OBJECT AND SUMMARY OF THE INVENTION

The present invention meets this object by providing a drafting and spinning apparatus that produces highly uniform yarns with improved mechanical properties. The spinning and drafting apparatus of the invention preferably comprises at least four pairs of drafting rolls for drawing a sliver formed of one or more types of staple fibers, each fiber type having a predetermined effective fiber length. The pairs of drafting rolls include a pair of back rolls, at least two pairs of intermediate rolls, and a pair of front rolls. The drafting roll pairs are spaced such that the nip of each of the drafting roll pairs is separated from the nip of the adjacent roll pairs by a predetermined distance such that the distance between the nip of the back rolls and the nip of the adjacent intermediate rolls and the distances between the nips of adjacent intermediate rolls is no more than the effective fiber length of the longest fiber type in the sliver. The drafted sliver is thereafter spun into yarn by spinning means, preferably at a take-up speed of greater than 150 meters/minute.

In an alternative embodiment, the present invention provides a method of producing highly uniform yarns with improved mechanical properties comprising advancing a sliver formed of one or more types of staple fibers, each staple fiber type having a predetermined effective fiber length, through at least four pairs of drafting rolls by maintaining the nip distance between the pair of back rolls and the pair of adjacent intermediate rolls and the nip distance between adjacent pairs of intermediate rolls at no more than the effective fiber length of the longest fiber type in the sliver and thereafter spinning the sliver into yarn, preferably at a take-up speed of greater than 150 meters/minute. Preferably, the sliver comprises staple polyester fibers having a predetermined mean decrimped fiber length and typically will consist of blends of between about 20% and 100% polyester fibers and between about 80% and 0% cotton fibers. The polyester fibers used in the invention preferably are high cohesion fibers having a denier per filament of between about 0.5 and about 2.5 and a mean decrimped fiber length of less than about 2.00 inches.

In yet another embodiment of the invention, the present invention includes a spun yarn consisting of a blend of polyester and cotton fibers forming a parallel fiber core held together by wrapping fibers and having a mean tenacity of at least about 1.50 gf/den, a mean single-end strength of greater than about 190 gf, a maximum strength of greater than about 245 gf, and less than 700 thin and thick defects per 1000 yards.

The present invention provides a drafting and spinning apparatus which produces highly uniform yarns having improved mechanical properties. Specifically, the yarns produced according to the invention have increased strength and less defects than similar yarns produced according to conventional processes.

These and other advantages of the present invention will become more readily apparent upon consideration of the following detailed description and accompanying drawings which describe both the preferred and alternative embodiments of the invention.

DETAILED DESCRIPTION OF THE INVENTION

Figure 1:
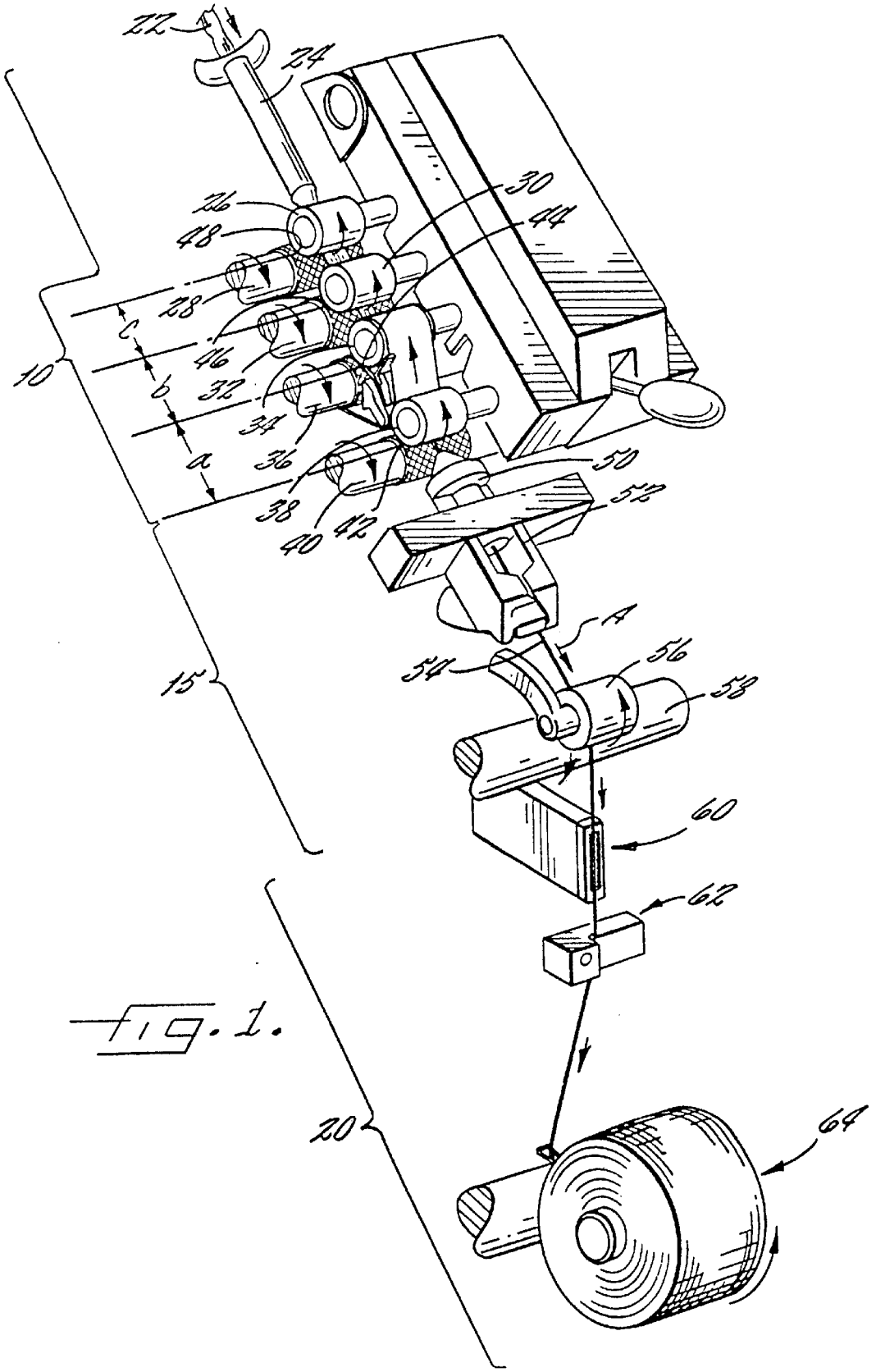
FIG. 1 is a perspective view of a drafting and spinning zone according to the present invention.

FIG. 1 illustrates a drafting and spinning apparatus according to the invention. As shown in FIG. 1, the drafting and spinning apparatus may be divided into a drafting zone 10, a spinning zone 15 and a take-up zone 20.

In the operation of the drafting and spinning apparatus of the invention, a sliver 22 of staple fibers is advanced to the drafting zone 10. The sliver 22 may be processed prior to entering the drafting zone 10 using otherwise conventional steps such as opening, blending, cleaning, carding and combing to provide the desired characteristics in the sliver or drafting and spinning. The sliver 22 used in the invention comprises one or more types of staple fibers, each staple fiber type having a predetermined effective fiber length. The "effective" fiber length as used herein refers to the mean decrimped fiber length of the fiber component prior to use in the sliver 22. The mean decrimped fiber length may be determined by fiber array testing of the fibers as described in ASTM method D-5103.

The sliver 22 used in the invention includes one or more types of staple fibers including cut synthetic fibers, natural fibers, and blends thereof. Exemplary types of synthetic fibers include polyester (e.g. polyethylene terephthalate), rayon, nylon, acrylic, acetate, polyethylene, polyurethane and polyvinyl fibers. Exemplary types of natural fibers include cotton, linen, flax, rayon, lyocell, viscose rayon, cellulose acetate, wool, ramie, alpaca, vicuna, mohair, cashmere, guanaco, camel, llama, fur and silk fibers. Preferably, the staple fibers used in the invention are polyester (polyethylene terephthalate) fibers, either alone, or blended with cotton fibers. For example, the sliver may consist of between about 20% and 100% polyester fibers and between about 80% and 0% cotton fibers. Typically, the polyester fibers have a cut length of between about 1.25 inches and 2.00 inches, preferably between 1.25 inches and 1.60 inches and a denier per filament of between about 0.5 and 2.5, preferably, between 0.7 and 1.5. The polyester fibers used in the sliver 22 preferably have high cohesion for use in the drawing and spinning apparatus of the invention. The high cohesion of the polyester fibers may be achieved by any suitable means known in the art such as the application of liquid finishes to the polyester fibers.

As shown in FIG. 1, the sliver 22 is advanced through a trumpet guide 24 which gathers the staple fibers together and then to a series of drafting roll pairs. The series of drafting roll pairs includes a pair of back rolls 26 and 28; at least one pair of intermediate rolls 30 and 32, and 34 and 36; and a pair of front rolls 38 and 40. Preferably, as shown in FIG. 1, the pair of intermediate rolls 34 and 36 adjacent the pair of front rolls 38 and 40 is a pair of apron rolls. For use in the invention, the series of drafting rolls preferably consists of at least four pairs or drafting rolls as, for example, the four roll pair arrangement illustrated in FIG. 1. Nevertheless, the invention may also be applied to three roll pair arrangements having only one intermediate pair of drafting rolls.

The pairs of drafting rolls in the drafting zone 10 operate such that the speed of the roll pairs increase in the direction of sliver movement as indicated, e.g., by directional arrow A, thereby drafting the sliver 22 down to yarn size. As illustrated in FIG. 1, typically the top roll in the roll pair 26, 30, 34 and 38, rotates in a direction opposite that of the bottom roll in the roll pair 28, 32, 36 and 40. As is well known to one skilled in the art, the ratio between the weight or length of the sliver 22 fed into the drafting zone 10 and the weight or length of the sliver exiting the drafting zone is known as the draft ratio. The draft ratio may also be measured across individual roll pairs such as the break draft (between the back rolls and intermediate rolls), the intermediate draft (between the intermediate rolls and the apron rolls), and the main draft (between the apron rolls and the front rolls). Preferably, in the present invention, the overall draft ratio is between about 50 and about 220, more preferably between about 130 and about 200. Typically, the majority of drafting occurs in the main draft. The width of the sliver 22 and thus the draft ratio may be affected by the speeds selected for the drafting rolls or a sliver guide (not shown) located between adjacent rolls pairs such as intermediate roll pairs 30 and 32, and 34 and 36.

Figure 2:
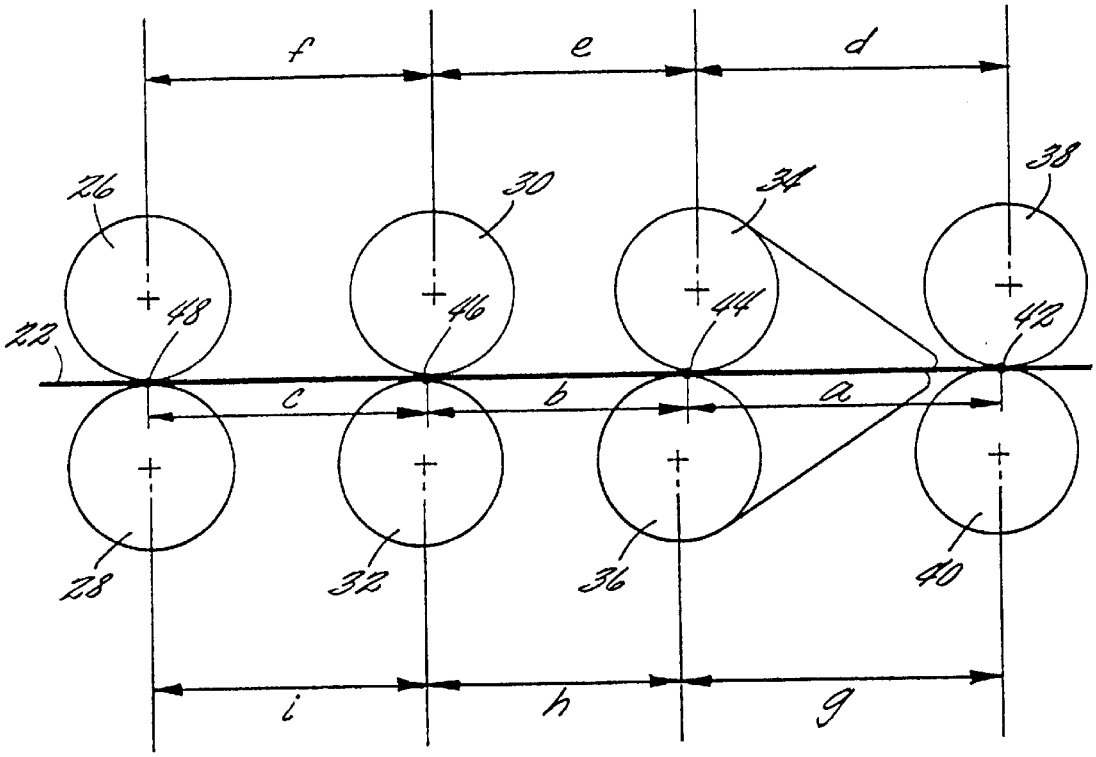
FIG. 2 is a side plan view of a drafting zone according to the invention.

In the drafting zone 10, the distances between adjacent roll pairs or nips are typically preset depending on numerous factors including the staple fiber length, break draft and fiber cohesive forces. As illustrated in FIGS. 1 and 2, the distances between adjacent nips 42 (for the front roll pair), 44 (for the apron roll pair), 46 (for the intermediate roll pair) and 48 (for the back roll pair) are a, b and c, respectively. The distance between nips may be fairly approximated by averaging the distance between adjacent ton rolls and the distance between corresponding adjacent bottom rolls. For example, if the spacings (FIG. 2) between adjacent top rolls are d=48 mm, e=37 mm, and f=35 mm, respectively, and the spacings between bottom rolls are g=44 mm, h=35 mm and i=35 mm, respectively, than the distances a, b and c, between adjacent nips would be a=46 mm, b=36 mm and c=35 mm. respectively. In addition to the roll spacings, various diameters for the drafting rolls may be selected for use in the invention and larger diameter rolls may be selected to further increase contact with the sliver 22 and thus increase the quality of the resulting spun yarn.

The conventional wisdom regarding roll spacing for a drafting zone 10 has been to set the distance between nips in adjacent drafting roll pairs to a distance of greater than the staple fiber length to prevent individual fibers from bridging adjacent pairs of drafting rolls and breaking. It has been unexpectedly discovered in the present invention, however, that narrowing the distance between the nip 48 of the back rolls and the nip 46 of the adjacent intermediate rolls and the distances between the nips of adjacent intermediate rolls (e.g., 46 and 44) to no more than the effective fiber length of the longest fiber type in the sliver 22 results in spun yarns having greater uniformity and mechanical properties, particularly for high-speed spinning processes (i.e., 150 meters/minute). For example, if the sliver 22 consists of 80% cotton fibers having an effective fiber length of 1.0 inch and 20% polyester fibers having an effective fiber length of 1.5 inches, then the distances b and c would be no more than 1.50 inches (38 mm), and may be 36 mm and 37 mm, respectively. The longest fiber type in the sliver 22 refers to the fiber type having the longest effective fiber length and forming a substantial portion of the sliver 22 (at least about 5%). Stated differently, fiber types which do not constitute at least about 5% of the sliver are not used to determine the longest fiber type in the sliver and thus the roll spacing in the drafting zone 10.

Figure 3:
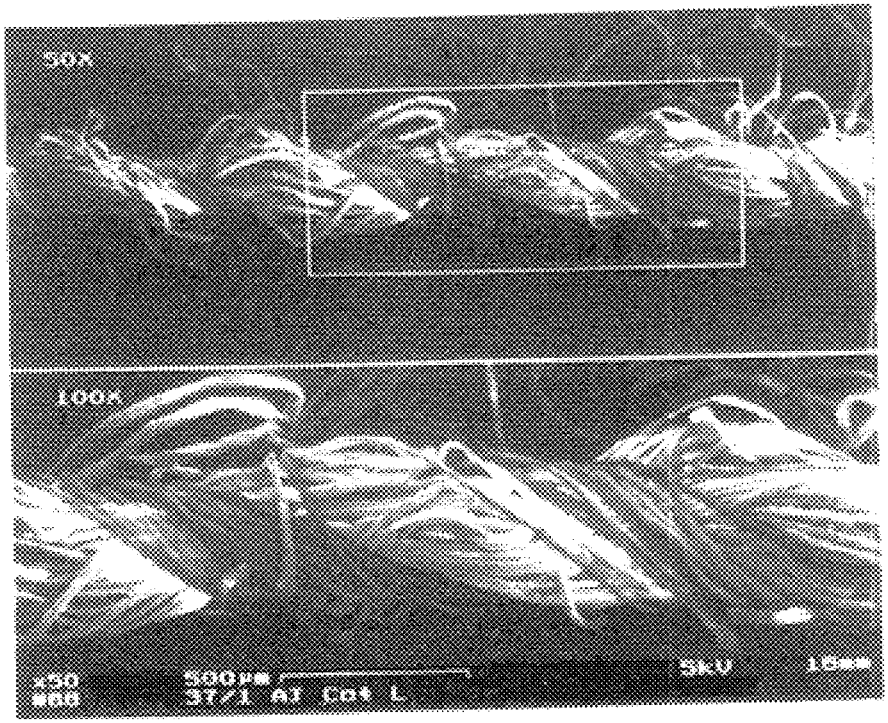
FIG. 3 is a microscopy photograph of a air-jet spun yarn produced according to the present invention.
Figure 4:
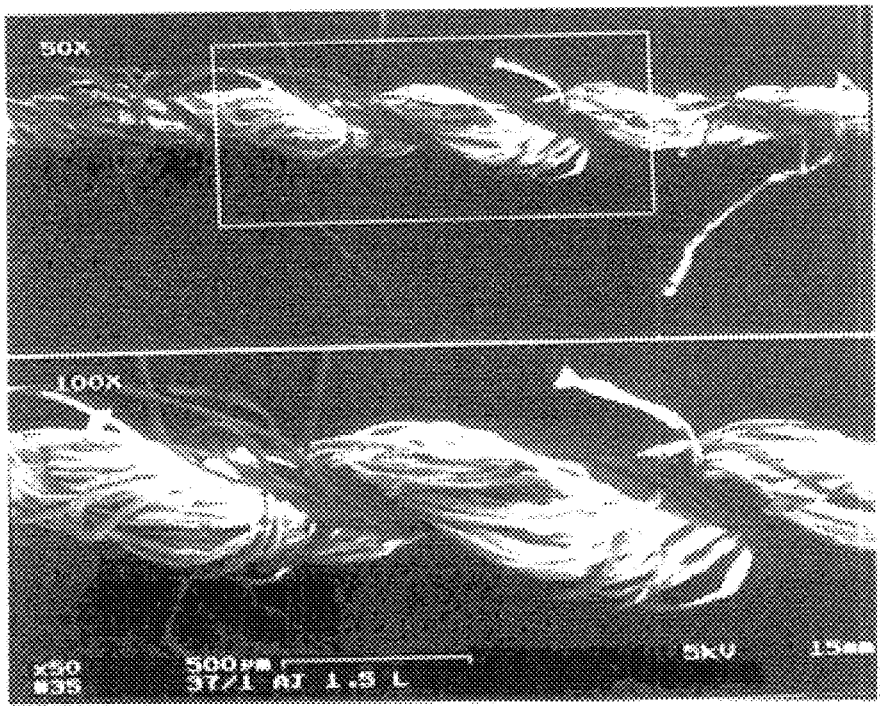
FIG. 4 is a microscopy photograph of a air-jet spun yarn produced according to the conventional method of drawing sliver to form yarn.

Although not wishing to be bound by a particular theory, it is believed that roll spacings tighter than the effective fiber length of the longest fiber type in the sliver 22 in the break and intermediate draft zones reduce fiber slippage at each nip point and thereby increase drafting control on the sliver. This greater control increases fiber alignment and uniformity in the drafted sliver 22 as it is introduced to the front drafting zone. A high cohesion sliver is preferred because it is believed to prevent fibers from slipping under the higher drafting force generated by the tighter roll spacings. Because the sliver 22 entering the front drafting zone is highly uniform and aligned because of the tighter roll spacings, the sliver 22 exits the front roll nip even more uniform and aligned. Accordingly, the more uniform and aligned sliver entering the spinning zone 15 creates a unique spun yarn. Upon examination of the spun yarns through microscopy, more wrapper fibers appear to be generated in this yarn (FIG. 3) at the same spinning conditions than with yarn produced from sliver drafted with the conventional wider roll spacings in the back and intermediate drafting zones (FIG. 4). It is believed that the number and frequency of the wrapper fibers increase because of the greater fiber alignment in the sliver 22. The greater number of wrapper fibers combined with the more uniform and aligned sliver going into the spinning zone is believed to create a spun yarn with increased strength and reduced quality defects. Furthermore, the improvements in the yarn may result in improvements in the weaving performance of the yarn and the potential use of yarns, specifically air-jet yarns, in some knit applications.

In addition to the above, it is believed that the speed and the mass of the sliver 22 used in the drafting zone 10 may contribute to the benefits of the invention. By way of example, in four-roll systems used according to the invention, the speed in the break and intermediate draft zones is about 3 times faster at the second nip roll than in ring spinning draft systems. The mass of the sliver 22 entering the drafting zone 10 is also typically 2 times greater than the roving entering a typical ring spinning draft system. The combination of greater speed and fiber mass is believed to make fiber slippage at the nip points more likely in the higher speed four-roll drafting system (e.g., MJS drafting system) thus providing the benefits of the invention in the higher speed four-roll system and not in ring spinning systems.

Once the sliver 22 exits the drafting zone 10, it is advanced to the spinning zone 15. The spinning apparatus in the spinning zone 15 selected for use in the present invention operates at higher speeds than associated with ring spinning. Exemplary spinning means which operates at these speeds and which use roller drafting systems include air-jet spinning means and roller Jet spinning means. Generally, the spinning means operates at a take-up speed of greater than about 150 meters/minute, preferably, of greater than about 190 meters/minute and more preferably, of greater than about 220 meters/minute. The spinning apparatus is typically capable of producing yarns having counts between 9 and 50, preferably 26 and 42. An exemplary spinning apparatus is an air-jet spinning apparatus such as the MJS 802H spinning apparatus from Murata Machinery Limited.

FIG. 1 illustrates an air-jet spinning apparatus for use in the invention. In the spinning zone 15, the sliver 22 enters a jet spinner 50 and air nozzle 52 wherein the drafted sliver is twisted by opposing air vortices to form a yarn 54. The spun yarn 54 is then advanced to the take-up zone 20 and specifically, to a pair of delivery rolls 56 and 58. The spinning zone 15 also includes a slack tube 60 to hold any accumulated fiber during the start-up of the drafting and spinning apparatus. The yarn 54 is then cleared by a yarn clearer 62 and collected on a take-up roll 64.

As described above, the spun yarn produced according to the invention has high uniformity and improved mechanical properties over conventional yarns produced according to conventional constructions having broader roll spacing. Specifically, the spun yarn produced according to the invention has increased strength and reduced defects over conventional yarns formed using broad roll spacing. The benefits of the present invention will now be further illustrated by the following non-limiting examples.

EXAMPLES 1–6 AND COMPARATIVE EXAMPLES 1–6

Various silvers consisting of intimately blended 50% FORTREL® Type 510 polyester (available from Wellman, Inc.) and 50% cotton stable fibers was advanced through a four roll drafting zone and spun using an MJS 802H air-jet spinner from Murata Machinery Limited with an H3 air nozzle at a speed of 273 meters/minute. The air-jet spinning apparatus was preset at a feed ratio of 0.98, a condenser setting of 3 mm, an apron spring tension of 3 kg, a Nozzle 1 (N1) to front roll distance of 39.0 mm, a N1 pressure of 2.5 $kgf/cm^2$ and a Nozzle 2 (N2) pressure of 5.5 $kgf/cm^2$. The polyester fibers in the sliver had a nominal cut length (effective length) of 1.5 inches (38 mm) and a denier per filament of 0.9. The polyester fibers had high cohesion through the use of liquid finishes and the Rothschild cohesion of the sliver ranged from 220 cN to 253 cN. The yarn count of the spun yarn was measured at between 37.0 and 37.9.

In Examples 1–6, a narrow roll spacing was selected according to the invention wherein the top roll spacings were preset at 48 mm, 36 mm, and 36 mm (d, e and f, respectively, in FIG. 2) and the bottom roll spacings were preset at 44 mm, 37 mm and 36 mm (g, h and i, respectively, in FIG. 2). The distances between the nips were 46 mm, 36.5 mm and 36 mm (a, b and c, respectively in FIG. 2). The draft ratio across the drafting zone was 171 consisting of a break draft of 2.0, an intermediate draft of 2.1 and a main draft of 40.

In Comparative Examples 1–6, a broad roll spacing such as those conventionally used in the art was selected wherein the top roll spacings were preset at 48 mm, 39 mm, and 42 mm (d, e and f, respectively, in FIG. 2) and the bottom roll spacings were preset at 44 mm, 41.5 mm and 42 mm (g, h and i, respectively, in FIG. 2). The distances between the nips were 46 mm, 40.25 mm and 42 mm (a, b and c, respectively in FIG. 2). The draft ratio used was the same as in Examples 1–6.

The yarns produced in Examples 1–6 and Comparative Examples 1–6 were tested or mechanical properties and uniformity. The mechanical properties of the yarns were tested using a Statimat testing apparatus at 100 breaks and the yarn quality was determined using a Uster 3 Evenness Tester for 1,000 yards. The results are provided in TABLE 1.

TABLE 1

| 37.8/1 50/50 0.9 dpf × 1.5 inch Polyester/Cotton Yarn | | | | | | |
|---|---|---|---|---|---|---|
| Fiber Variant | 1 | 1 | 2 | 2 | 3 | 3 |
| MJS Bottom Roll Spacings (mm) | 44-37-36 | 44-41.5-42 | 44-37-36 | 44-41.5-42 | 44-37-36 | 44-41.5-42 |
| MJS Top Roll Spacings (mm) | 48-36-36 | 48-39-42 | 48-36-36 | 48-39-42 | 48-36-36 | 48-39-42 |
| Yam Count (Ne) | 37.0 | 37.8 | 37.5 | 37.7 | 37.5 | 37.3 |
| Statimat Data (100 breaks) | | | | | | |
| Mean Tenacity (gf/den) | 1.84 | 1.66 | 1.95 | 1.72 | 1.99 | 1.73 |
| Mean Single-End Strength (gf) | 264.8 | 233.3 | 275.8 | 244.5 | 282.1 | 243.6 |
| Maximum Strength (gf) | 346.1 | 276.4 | 344.9 | 311.2 | 373.5 | 296.3 |
| Minimum Strength (gf) | 188.0 | 183.0 | 199.2 | 184.3 | 216.6 | 190.5 |
| Uster 3 Yarn Evenness Data | | | | | | |
| IPI Thin Places (−50%) | 65 | 96 | 59 | 126 | 83 | 96 |
| IPI Thick Places (+50%) | 289 | 403 | 220 | 408 | 292 | 301 |
| IPI Neps(+200%) | 682 | 1110 | 546 | 1257 | 798 | 943 |
| Total IPI's | 1036 | 1609 | 825 | 1791 | 1173 | 1340 |
| Fiber Variant | 4 | 4 | 5 | 5 | 6 | 6 |
| MJS Bottom Roll Spacings (mm) | 44-37-36 | 44-41.5-42 | 44-37-36 | 44-41.5-42 | 44-37-36 | 44-41.5-42 |
| MJS Top Roll Spacings (mm) | 48-36-36 | 48-39-42 | 48-36-36 | 48-39-42 | 48-36-36 | 48-39-42 |
| Yam Count (Ne) | 37.5 | 37.8 | 37.5 | 37.5 | 37.5 | 37.9 |
| Statimat Data (100 breaks) | | | | | | |
| Mean Tenacity (gf/den) | 1.79 | l.70 | 1.90 | 1.71 | 1.91 | 1.75 |
| Mean Single-End Strength (gf) | 253.8 | 238.2 | 269.3 | 242.3 | 270.4 | 245.7 |
| Maximum Strength (gf) | 349.9 | 312.5 | 357.3 | 292.6 | 341.2 | 296.3 |
| Minimum Strength (gf) | 179.3 | 174.3 | 170.6 | 170.6 | 194.2 | 166.8 |
| Uster 3 Yarn Evenness Data | | | | | | |
| IPI Thin Places (−50%) | 97 | 103 | 72 | 95 | 70 | 90 |
| IPI Thick Places (+50%) | 336 | 355 | 281 | 322 | 268 | 341 |
| IPI Neps(+200%) | 950 | 1060 | 742 | 1027 | 765 | 1096 |
| Total IPI's | 1383 | 1518 | 1095 | 1444 | 1103 | 1527 |

Note:
Fiber variant 1 has third pass sliver Rothschild cohesion of 220 cN
Fiber variants 2 through 6 have increasingly higher cohesion up to 253 cN for variant 6

As shown in TABLE 1, the 50/50 polyester and cotton blends of the invention have a 12% average increase in mean single-end strength, a 10% average increase in minimum strength and greater than a 40% average reduction in the number of total defects, compared to the 50/50 blends prepared by conventional methods. The 50/50 spun yarns have a mean single-end strength of greater than about 250 gf, preferably greater than 260 gpf, and less than 1400 total defects per 1000 yards. The total defects per 1000 yards include the number of neps and the number of thick and thin defects in the yarn per 1000 yards. As noted in TABLE 1, a "thick" defect refers to a yarn portion 50% thicker than average and a "thin" defect refers to a yarn portion 50% thinner than average. In addition to these properties, the yarns have a mean tenacity of more than 1.75 gf/den, a maximum strength of greater than about 315 gf, and a minimum strength of greater than about 170 gf, each of which are improvements over conventionally produced 50/50 yarns.

EXAMPLES 7–12 AND COMPARATIVE EXAMPLES 7–12

A sliver consisting of intimately blended 40% FORTREL® Type 510 polyester (available from Wellman, Inc.) and 60% cotton stable fibers was advanced through a four roll drafting zone and spun using an MJS 802H air-jet spinner from Murata Machinery Limited with an H3 air nozzle at a speed of 233 meters/minute. The settings of the air-jet spinning apparatus were the same as in Examples 1–6 except the condenser spacing was 2 mm, the N1 to front roll distance was 39.0 mm and the N2 pressure was 5 kgf/cm$^2$. The polyester fibers in the sliver had a cut nominal length (effective length) of 1.5 inches (38 mm) and a denier per filament of 0.85. The polyester fibers in the sliver had high cohesion through the use of liquid finishes and the Rothschild cohesion of the sliver ranged from 183 to 202 cn. The yarn count of the spun yarn was measured at between 40.0 and 41.7.

The roll spacing used in Examples 1–6 and Comparative Examples 1–6 were used for Examples 7–12 and Comparative Examples 7–12, respectively. The draft ratio across the drafting zone was 194 consisting of a break draft of 2.0, an intermediate draft of 2.4 and a main draft of 40. The mechanical properties and the uniformity of the yarns, including the neps, thick and thin defects, were measured as described in Examples 1–6 and Comparative Examples 1–6. The results are provided in TABLE 2.

TABLE 2

| 41/1 40/60 0.85 dpf × 1.5 inch Polyester/Cotton Yarn | | | | | | |
|---|---|---|---|---|---|---|
| Fiber Variant | 1 | 1 | 2 | 2 | 3 | 3 |
| MJS Bottom Roll Spacings (mm) | 44-37-36 | 44-41.5-42 | 44-37-36 | 44-41.5-42 | 44-37-36 | 44-41.5-42 |
| MJS Top Roll Spacings (mm) | 48-36-36 | 48-39-42 | 48-36-35 | 48-39-42 | 48-36-36 | 48-39-42 |
| Yarn Count (Ne) | 41.0 | 41.7 | 40.0 | 41.1 | 41.0 | 41.0 |
| Statimat Data (100 breaks) | | | | | | |
| Mean Tenacity (gf/den) | 1.55 | 1.44 | 1.52 | 1.39 | 1.58 | 1.40 |
| Mean Single-End Strength (gf) | 201.6 | 183.4 | 201.4 | 180.1 | 204.8 | 181.3 |
| Maximum Strength (gf) | 260.2 | 219.1 | 255.2 | 245.3 | 261.5 | 222.9 |
| Minimum Strength (gf) | 114.5 | 141.9 | 146.9 | 130.7 | 145.7 | 145.7 |
| Uster 3 Yarn Evenness Data | | | | | | |
| IPI Thin Places (−50%) | 163 | 236 | 173 | 175 | 171 | 210 |
| IPI Thick Places (+50%) | 489 | 622 | 474 | 528 | 442 | 577 |
| IPI Neps (+200%) | 1189 | 1113 | 1242 | 1035 | 1123 | 965 |
| Total IPI's | 1841 | 1971 | 1889 | 1738 | 1736 | 1752 |
| Fiber Variant | 4 | 4 | 5 | 5 | 6 | 6 |
| MJS Bottom Roll Spacings (mm) | 44-37-36 | 44-41.5-42 | 44-37-36 | 44-41.5-42 | 44-37-36 | 44-41.5-42 |
| MJS Top Roll Spacings (mm) | 48-36-36 | 48-39-42 | 48-36-35 | 48-39-42 | 48-36-36 | 48-39-42 |
| Yarn Count (Ne) | 41.0 | 41.5 | 41.0 | 41.7 | 40.5 | 41.2 |
| Statimat Data (100 breaks) | | | | | | |
| Mean Tenacity (gf/den) | 1.62 | 1.45 | 1.5 | 1.45 | 1.56 | 1.37 |
| Mean Single-End Strength (gf) | 209.5 | 186.8 | 194.8 | 184.5 | 204.5 | 176.6 |
| Maximum Strength (gf) | 272.7 | 225.3 | 246.5 | 237.8 | 271.4 | 222.6 |
| Minimum Strength (gf) | 161.9 | 139.4 | 114.5 | 127.0 | 135.7 | 141.9 |
| Uster 3 Yarn Evenness Data | | | | | | |
| IPI Thin Places (−50%) | 164 | 194 | 178 | 221 | 197 | 253 |
| IPI Thick Places (+50%) | 432 | 479 | 491 | 546 | 499 | 651 |
| IPI Neps (+200%) | 1203 | 1041 | 1255 | 1097 | 1219 | 1084 |
| Total IPI's | 1799 | 1714 | 1924 | 1864 | 1915 | 1988 |

Note:
Fiber variant 1 has third pass Rothschild cohesion of 183 cN
Fiber variants 2 through 6 have increasingly higher cohesion up to 202 cN for variant 6

As shown in TABLE 2, the 40/60 polyester and cotton blends of the invention have a 10% average increase in mean single-end strength, an improvement in short term evenness, and decreased thin and thick defects, compared to the 40/60 yarns produced by conventional methods. The 40/60 spun yarns have a mean single-end strength of greater than about 190 gf, preferably greater than about 200 gf, and less than 700 thin and thick defects per 1000 yards. Furthermore, the 40/60 spun yarn has a mean tenacity of at least about 1.50 gf/den, and a maximum strength of greater than about 245 gf, each of which are improvements over conventionally produced 40/60 yarns.

As demonstrated in TABLES 1 and 2, slivers of the same polyester/cotton blends and having the same finishes exhibit greatly increased strength and typically reduced detects when drawn according to the present invention as compared to conventional methods. The spun yarns in Examples 1–12 each have a mean tenacity of at least about 1.50 gf/den, a mean single-end strength of greater than about 190 gf, a maximum strength of greater than about 245 gf, and less than 700 thin and thick defects per 1000 yards, the combination of which is an improvement over the art as demonstrated in Comparative Examples 1–12.

In addition to measurable differences in the uniformity and mechanical properties of the yarns produced according to the invention, the visible quality of the yarns of the invention is readily apparent over conventional yarns. As illustrated in FIG. 3 (a microscopy photograph of the conventional yarn of Comparative Example 6) and FIG. 4 (a microscopy photograph of the yarn of Example 6 according to the present invention), the yarns of the invention have a visibly superior quality over the conventionally produced yarns. Although not wishing to be bound by a particular theory, it is believed that because of the increased control in the drafting zone of the invention, the wrapper fibers are twisted more frequently around the core fibers; i.e., have a sharper wrapping angle and more wraps per unit length. The resulting improvement in visible quality may be responsible for the decreased defects in the yarn and may also be responsible for the increased mechanical properties of the yarns of the invention.

Although the above description generally applies So high speed spinning processes, particularly air-jet spinning processes, it will be understood that the Invention is not limited thereto since modifications may be made by those skilled in the art, particularly in light of the foregoing description. Therefore, said modifications and embodiments are intended to be included within the spirit and scope of the following appended claims.

What is claimed is:

1. A spun yarn comprising a 50/50 blend of polyester and cotton fibers forming a parallel fiber core held together by wrapping fibers and having a mean single-end strength of greater than about 250 gf and less than 1400 total defects per 1000 yards.

2. The spun yarn according to claim 1 wherein the mean single end strength is greater than 260 gf and said yarn has less than 1200 total defects per 1000 yards.

3. The spun yarn according to claim 1 wherein the polyester fibers have a predetermined mean decrimped fiber length of no more than about 2.00 inches.

4. The spun yarn according to claim 1 wherein the polyester fibers have a denier per filament of between about 0.5 and about 2.5.

5. The spun yarn according to claim 1 having a mean tenacity of more than 1.75 gf/den.

* * * * *